US011695242B2

(12) United States Patent
Kim et al.

(10) Patent No.: US 11,695,242 B2
(45) Date of Patent: Jul. 4, 2023

(54) CONNECTOR ASSEMBLY

(71) Applicants: Hyundai Motor Company, Seoul (KR); Kia Corporation, Seoul (KR); Korea Electric Terminal Co., Ltd., Incheon (KR)

(72) Inventors: Ji Hyoung Kim, Gunpo-si (KR); Jung Nan Ryu, Gunpo-si (KR); Seung Woo Woo, Incheon (KR); Mun Sung Choi, Incheon (KR)

(73) Assignees: Hyundai Motor Company, Seoul (KR); Kia Corporation, Seoul (KR); Korea Electric Terminal Co., Ltd., Incheon (KR)

( * ) Notice: Subject to any disclaimer, the term of this patent is extended or adjusted under 35 U.S.C. 154(b) by 5 days.

(21) Appl. No.: 17/477,017

(22) Filed: Sep. 16, 2021

(65) Prior Publication Data

US 2022/0173552 A1 Jun. 2, 2022

(30) Foreign Application Priority Data

Nov. 27, 2020 (KR) ..... 10-2020-0162341

(51) Int. Cl.

| | |
|---|---|
| ***H01R 13/719*** | (2011.01) |
| ***H01R 13/502*** | (2006.01) |
| ***H01R 13/658*** | (2011.01) |
| ***H01R 13/629*** | (2006.01) |
| ***H01R 13/639*** | (2006.01) |

(52) U.S. Cl.

CPC ..... *H01R 13/719* (2013.01); *H01R 13/502* (2013.01); *H01R 13/629* (2013.01); *H01R 13/639* (2013.01); *H01R 13/658* (2013.01)

(58) Field of Classification Search

CPC .. H01R 13/719; H01R 13/502; H01R 13/629; H01R 13/658

USPC ..... 439/676

See application file for complete search history.

(56) References Cited

U.S. PATENT DOCUMENTS

2004/0161975 A1* 8/2004 Sakai ..... H01R 12/7088 439/620.21
2014/0017913 A1* 1/2014 Colwell ..... H01R 11/01 29/842
2015/0288082 A1* 10/2015 Miyawaki ..... H01R 31/085 439/810

(Continued)

FOREIGN PATENT DOCUMENTS

KR 20180044090 A 5/2018

*Primary Examiner* — Alexander Gilman

(74) *Attorney, Agent, or Firm* — Slater Matsil, LLP

(57) ABSTRACT

An embodiment connector assembly includes a housing including an inner space formed therein, wherein ends of a main-line terminal and a sub-line terminal are inserted into a first side of the inner space, a main-line port inserted into and fixed to the inner space of the housing and electrically connected to the end of the main-line terminal inserted into the inner space, a sub-line port inserted into and fixed to the inner space of the housing and electrically connected to the end of the sub-line terminal inserted into the inner space, and a noise filter disposed between the main-line port and the sub-line port and electrically connected to each of the main-line port and the sub-line port, wherein the noise filter is configured to reduce a noise in a signal transmitted between the main-line port and the sub-line port.

20 Claims, 6 Drawing Sheets

(56) References Cited

U.S. PATENT DOCUMENTS

| | | | | |
|---|---|---|---|---|
| 2016/0006186 | A1* | 1/2016 | Aizawa | H01R 13/6625 439/620.09 |
| 2017/0102423 | A1* | 4/2017 | Maalouf | H01R 13/502 |
| 2018/0115116 | A1* | 4/2018 | Han | H01R 43/205 |
| 2018/0294605 | A1* | 10/2018 | Iizuka | H01R 13/504 |
| 2018/0301854 | A1* | 10/2018 | Iizuka | H01R 13/7193 |
| 2018/0375261 | A1* | 12/2018 | Iizuka | H02G 3/088 |
| 2020/0144762 | A1* | 5/2020 | Kim | H01R 13/5208 |
| 2020/0153154 | A1* | 5/2020 | Mamiya | H01R 13/5202 |
| 2022/0045455 | A1* | 2/2022 | Park | H01R 13/53 |
| 2022/0123494 | A1* | 4/2022 | Kim | H01R 13/6658 |
| 2022/0131321 | A1* | 4/2022 | Kim | H01R 12/585 |
| 2022/0140531 | A1* | 5/2022 | Kim | H01R 13/436 439/660 |
| 2022/0173552 | A1* | 6/2022 | Kim | H01R 13/502 |
| 2022/0294308 | A1* | 9/2022 | Yamakage | H02K 5/10 |

* cited by examiner

CONNECTOR ASSEMBLY

CROSS-REFERENCE TO RELATED APPLICATIONS

This application claims the benefit of Korean Patent Application No. 10-2020-0162341, filed on Nov. 27, 2020, which application is hereby incorporated herein by reference.

TECHNICAL FIELD

The present disclosure relates to a connector assembly.

BACKGROUND

In recent years, various electronic devices have been developed in which a housing made of an insulating material is disposed in the electronic device, a connector including a terminal made of a conductive material is disposed in the housing, and the terminals are electrically connected to each other through the connector to form a circuit.

In particular, information may be transmitted to a joint connector used for a wire harness of a vehicle, in the vehicle through a controller area network (CAN) communication, and a large amount of information may be transmitted to the communication joint connector for a vehicle safety and convenience system.

A controller area network with flexible data-rate (CAN-FD) has been recently used to improve the stability and convenience of the vehicle, and its malfunction may thus occur due to a noise in the transmitted signal, which is caused by an increased communication speed and an increased operation frequency.

In particular, a large noise may occur in the signal as the number and length of the main line and sub-line of the wire harness are changed, and there has thus been a restriction on a degree of freedom in designing the wire harness to have its optimized design for preventing such a noise from occurring in the signal.

The contents described as the related art have been provided only to assist in understanding the background of the present disclosure and should not be considered as corresponding to the related art known to those having ordinary skill in the art.

SUMMARY

The present disclosure relates to a connector assembly. Particular embodiments relate to a joint connector assembly reducing a noise of a transmitted signal.

An embodiment of the present disclosure provides a connector assembly including a filter embedded to remove a noise from an input signal.

According to an embodiment of the present disclosure, a connector assembly includes a housing in which an inner space is formed and ends of a main-line terminal and a sub-line terminal are inserted into one side of the inner space, a main-line port inserted into and fixed to the inner space of the housing and electrically connected to the end of the main-line terminal inserted into the inner space, a sub-line port inserted into and fixed to the inner space of the housing and electrically connected to the end of the sub-line terminal inserted into the inner space, and a noise filter disposed between the main-line port and the sub-line port, electrically connected to each of the main-line port and the sub-line port, and reducing a noise in a signal transmitted between the main-line port and the sub-line port.

The noise filter may be a low-pass filter for the signal transmitted between the main-line port and the sub-line port.

The noise filter may be a resistor electrically connecting between the main-line port and the sub-line port.

The connector assembly may further include a holder coupled to the housing in the inner space of the housing to fix positions of the main-line terminal and the sub-line terminal.

The plurality of main-line terminals and the plurality of sub-line terminals may be provided and disposed to be spaced apart from each other on the holder in a vertical direction.

The sub-line port may include a plurality of pins disposed to be spaced apart from each other in a lateral direction to be electrically connected to the plurality of sub-line terminals, respectively, and a busbar integrally connected to the plurality of pins, and the main-line port and the sub-line port are disposed to be spaced apart from each other in the lateral direction.

The plurality of noise filters may be provided and disposed to be spaced apart from each other on the holder in the vertical direction, and the plurality of noise filters may be respectively disposed between the plurality of main-line ports and the plurality of sub-line ports.

The connector assembly may further include a cover fastened to the housing to cover the main-line port and the sub-line port from the other side of the inner space.

The connector assembly may further include a retainer fastened to the housing to cover the main-line port and the sub-line port from the one side of the inner space, having through holes penetrated to allow the ends of the main-line terminal and sub-line terminal to be inserted thereinto, and supporting the main-line terminal and the sub-line terminal which are inserted into the inner space.

The connector assembly may further include a sealing member inserted into the one side of the inner space, covered by the retainer, and having covering holes surrounding outer peripheral surfaces of the main-line terminal and sub-line terminal which are inserted into the inner space through the through holes.

The connector assembly may further include a fixing member inserted into the one side of the inner space, covered by the retainer, and caught by and coupled to the ends of the main-line terminal and sub-line terminal, which are inserted into the inner space through the through holes to prevent separations of the main-line terminal and the sub-line terminal.

DETAILED DESCRIPTION OF ILLUSTRATIVE EMBODIMENTS

Figure 1:
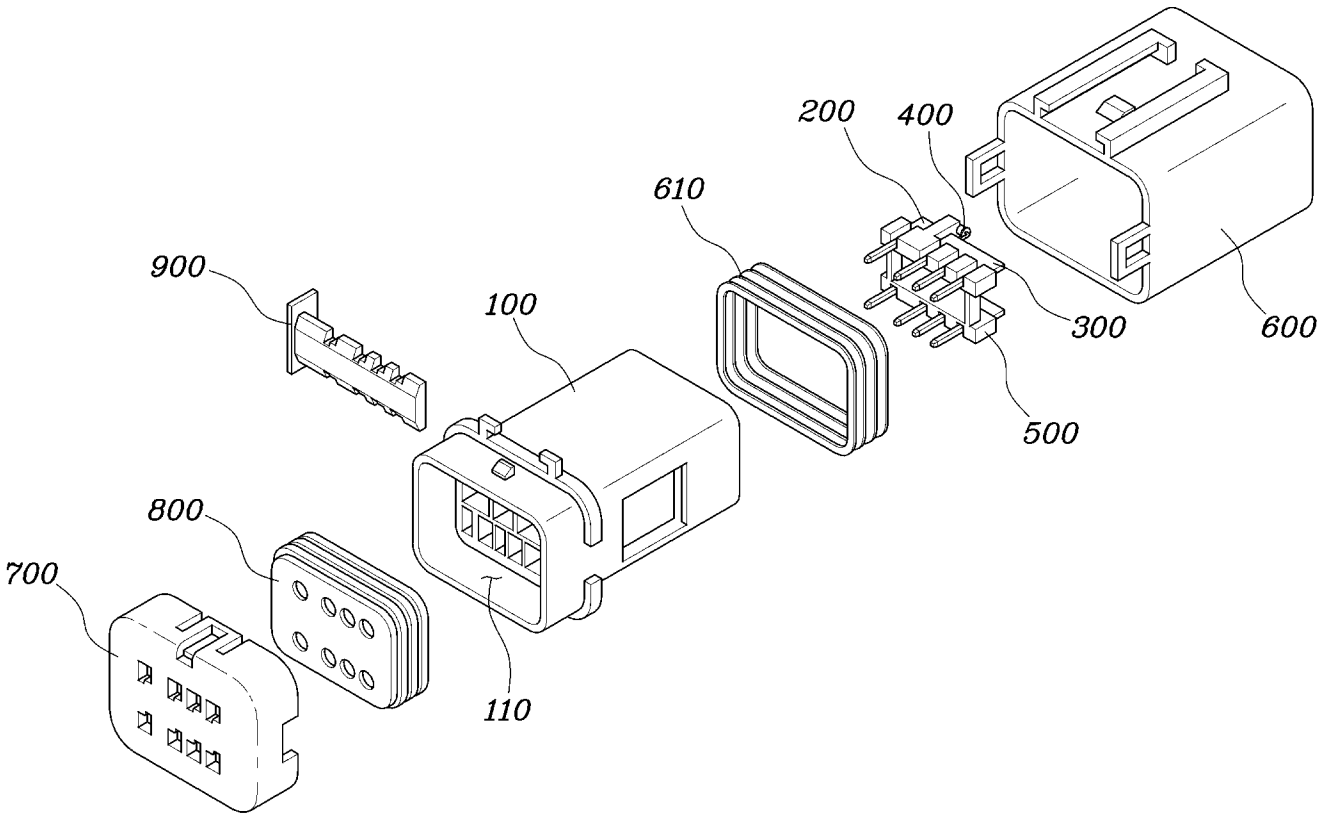
FIGS. 1 and 2 are perspective views each showing an exploded state of a connector assembly according to an embodiment of the present disclosure.

Specific descriptions on the structure and function of embodiments of the present disclosure described herein are merely illustrative. The embodiments may be implemented in various forms and the above descriptions are not construed to limit the present disclosure thereto.

The present disclosure may be variously modified and have several embodiments, and specific embodiments will thus be shown in the accompanying drawings and be described in detail. However, it is to be understood that the present disclosure is not limited to the specific embodiments, and includes all modifications, equivalents and substitutions included in the spirit and the scope of the present disclosure.

Terms such as 'first', 'second' and the like may be used to describe various components, and the components are not to be construed as being limited to the terms. The terms are used only to distinguish one component from another component. For example, the 'first' component may be named the 'second' component and the 'second' component may also be similarly named the 'first' component, without departing from the scope of the present disclosure.

It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween. Other expressions describing a relationship between components, that is, "between," "directly between," "neighboring to," "directly neighboring to" and the like, should be similarly interpreted.

Terms used in the present specification are used only in order to describe specific embodiments rather than limiting the present disclosure. Singular forms used herein are intended to include plural forms unless explicitly indicated otherwise. It will be further understood that the terms "comprise" or "have" used in this specification specify the presence of stated features, numerals, steps, operations, components, parts, or a combination thereof, and do not preclude the presence or addition of one or more other features, numerals, steps, operations, components, parts, or a combination thereof.

Unless indicated otherwise, it is to be understood that all the terms used in the specification including technical and scientific terms have the same meaning as those that are understood by those skilled in the art. It must be understood that the terms defined by the dictionary are identical with the meanings within the context of the related art, and they should not be ideally or excessively formally defined unless the context clearly dictates otherwise.

Hereinafter, embodiments of the present disclosure are described in detail with reference to the accompanying drawings. Like reference numerals proposed in each drawing denote like components.

Figure 2:
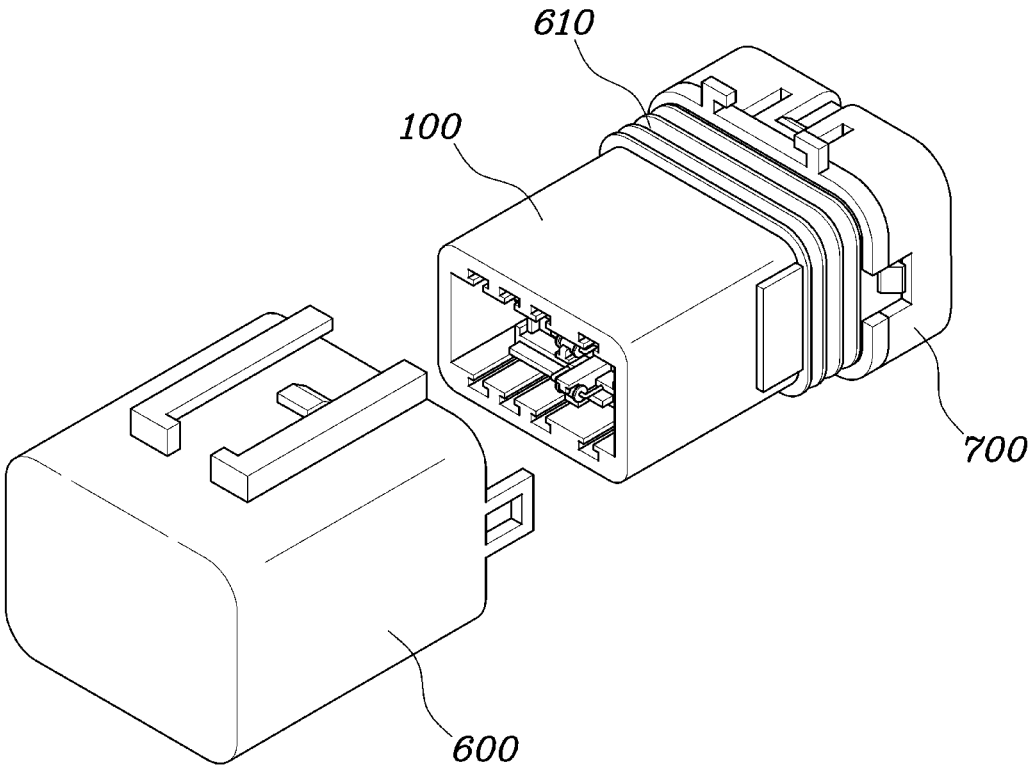
Figure 3:
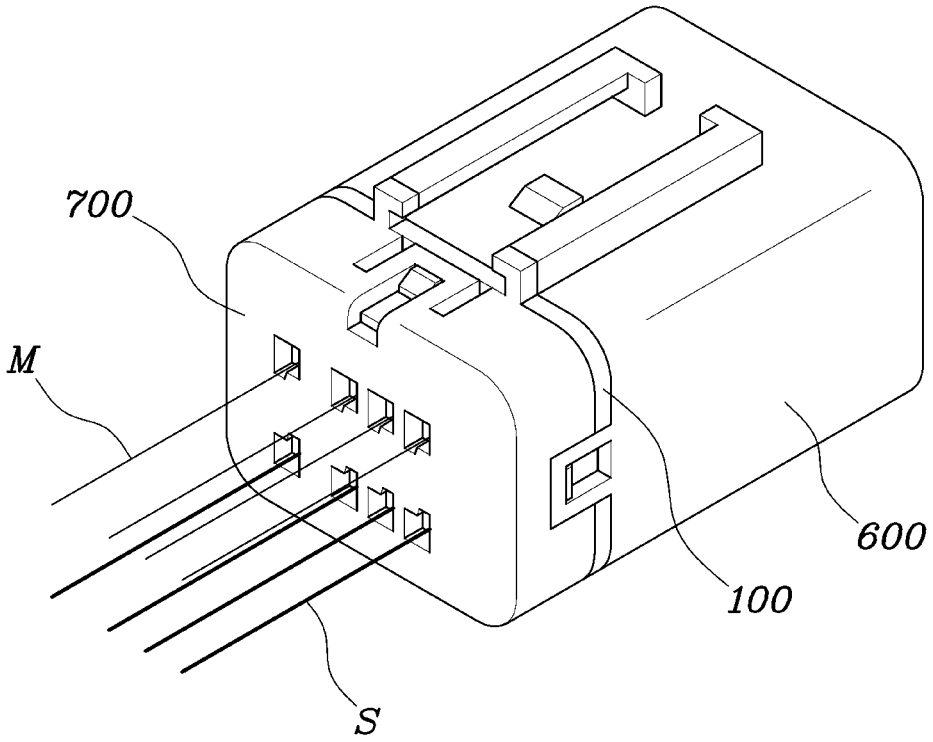
FIG. 3 is a perspective view showing a coupled state of the connector assembly according to an embodiment of the present disclosure.

FIGS. 1 and 2 are perspective views each showing an exploded state of a connector assembly according to an embodiment of the present disclosure, and FIG. 3 is a perspective view showing a coupled state of the connector assembly according to an embodiment of the present disclosure.

Referring to FIGS. 1 to 3, the connector assembly according to an embodiment of the present disclosure includes a housing 100 in which an inner space 110 is formed and ends of a main-line terminal M and a sub-line terminal S are inserted into one side of the inner space 110, a main-line port 200 inserted into and fixed to the inner space 110 of the housing 100 and electrically connected to the end of the main-line terminal M inserted into the inner space 110, a sub-line port 300 inserted into and fixed to the inner space 110 of the housing 100 and electrically connected to the end of the sub-line terminal S inserted into the inner space 110, and a noise filter 400 disposed between the main-line port 200 and the sub-line port 300, electrically connected to each of the main-line port 200 and the sub-line port 300, and reducing a noise in a signal transmitted between the main-line port 200 and the sub-line port 300.

The housing 100 may be hollow and have the inner space 110. The housing 100 may be open for its opposite sides to be connected to each other passing through the inner space 110 of the housing 100, or may be blocked by having either one side open or the other side open.

The one side of the housing 100 may be open for the ends of the main-line terminal M and sub-line terminal S to be inserted thereinto. In particular, the one side of the housing 100 may be formed in such a manner that the ends of the main-line terminal M and the sub-line terminal S are inserted into the inside while being spaced apart from each other.

The ends of the main-line terminal M and the sub-line terminal S may be inserted into the inner space 110 of the housing 100. In particular, the main-line terminal M and the sub-line terminal S may be inserted through the one side of the inner space 110 to be in contact with the main-line port 200 and the sub-line port 300 in the inner space 110 of the housing 100.

The main-line terminal M and the sub-line terminal S may be female type terminals electrically connected to the main-line port 200 and the sub-line port 300 disposed in the inner space 110 of the housing 100, respectively.

In addition, the main-line terminal M and the sub-line terminal S may be W/seal compressed. In particular, the main-line terminal M and the sub-line terminal S may each be W/seal compressed at a position separated from its end and thus each be sealed from the outside of the housing 100 while its end is inserted into the inner space 110 of the housing 100.

The main-line port 200 and the sub-line port 300 may each be inserted into the inner space 110 of the housing 100. In an embodiment, the main-line port 200 and the sub-line port 300 may each be inserted into the other side of the inner space 110, and some pins to be described below may be exposed to the one side of the inner space 110.

The main-line port 200 and the sub-line port 300 may each be made of a conductive material electrically connected to each end of the main-line terminal M and the sub-line terminal S, which are inserted into and in contact with the inner space 110.

The noise filter 400 may be electrically connected between the main-line port 200 and the sub-line port 300, and may reduce a noise in an electrical signal, which is input or output to the main-line port 200, or input or output to the sub-line port 300. In particular, the noise filter 400 may reduce a noise caused by reflection of the input signal.

Accordingly, embodiments of the present disclosure may remove the noise even though the length of the main line or the sub-line is changed by embedding the filter removing the noise from the signal in the connector assembly, thereby having improved freedom in designing the main line or the sub-line.

In detail, the noise filter 400 may be a low-pass filter for the signal transmitted between the main-line port 200 and the sub-line port 300.

That is, the noise filter 400 may be the low-pass filter (LPF) allowing only a low-frequency signal to pass therethrough and blocking a high-frequency signal from passing therethrough.

In an embodiment, the noise filter 400 may use an RLC circuit including resistor (R), inductor (L), and capacitor (C) elements. In particular, the RLC circuit may allow only a signal corresponding to a specific frequency band including a resonance frequency to pass therethrough, and may remove the noise from a signal corresponding to the remaining frequency bands.

In particular, embodiments of the present disclosure may remove the noise from the signal corresponding to the high frequency band by including the low-pass filter using the RC circuit and the LC circuit. However, a ground path for the noise may be required when using such an RLC circuit.

In another embodiment, the noise filter 400 may be a resistor electrically connecting between the main-line port 200 and the sub-line port 300. The noise filter 400 may use a damping resistor attenuating its overshoot or undershoot. In particular, the damping resistor may serve a function similar to an RC integrating circuit filter.

Most integrated circuits (ICs) have several to tens of pF input/output capacity, and the resistors may thus serve as the low-pass filters when connected to each other in series.

This configuration may be used even though there is no ground path for the noise, and thus may be used for a controller area network (CAN)/a controller area network with flexible data-rate (CAN-FD).

Figure 4:
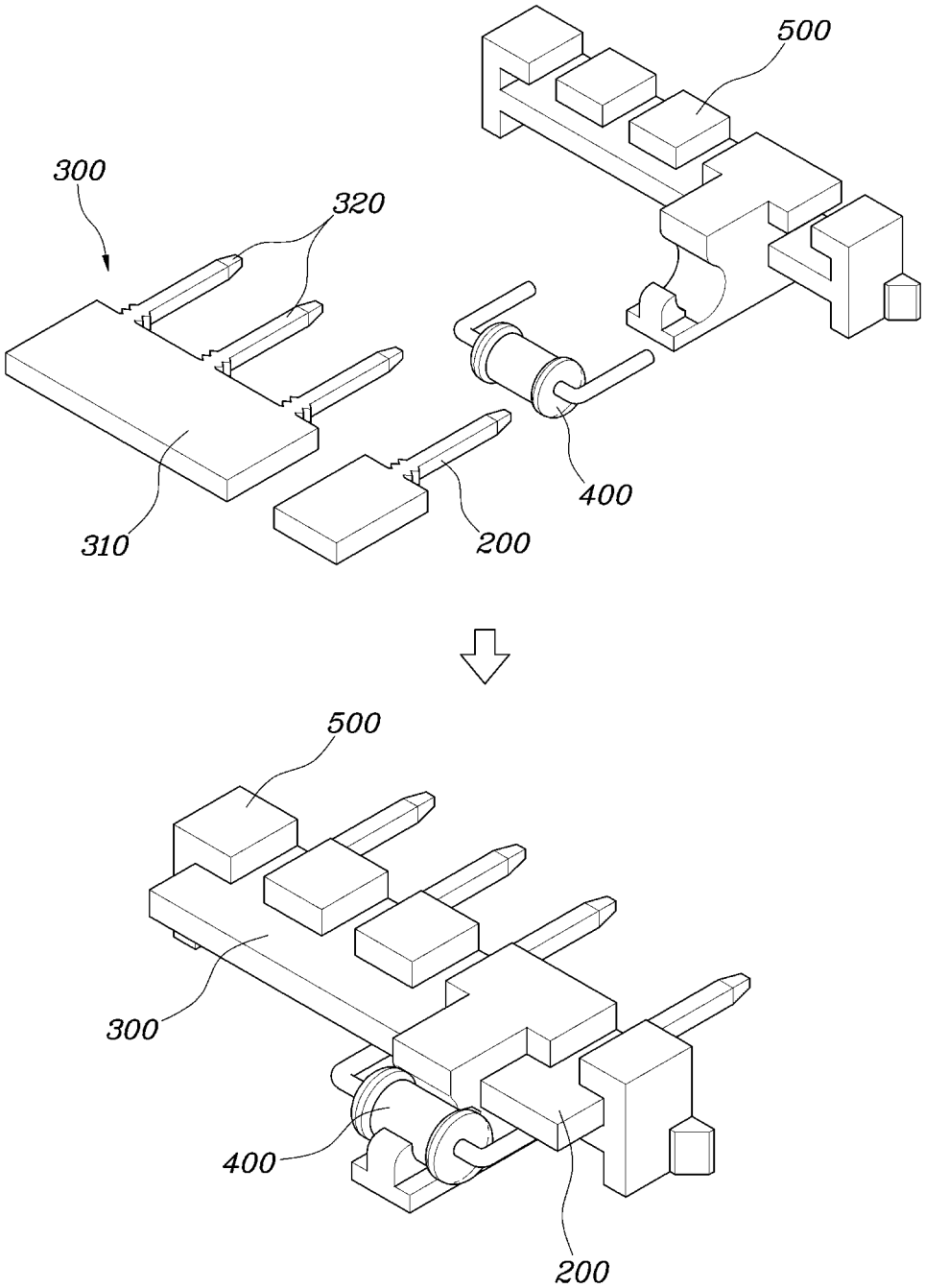
FIG. 4 shows that a main-line terminal, a sub-line terminal and a holder are coupled to one another according to an embodiment of the present disclosure.
Figure 5:
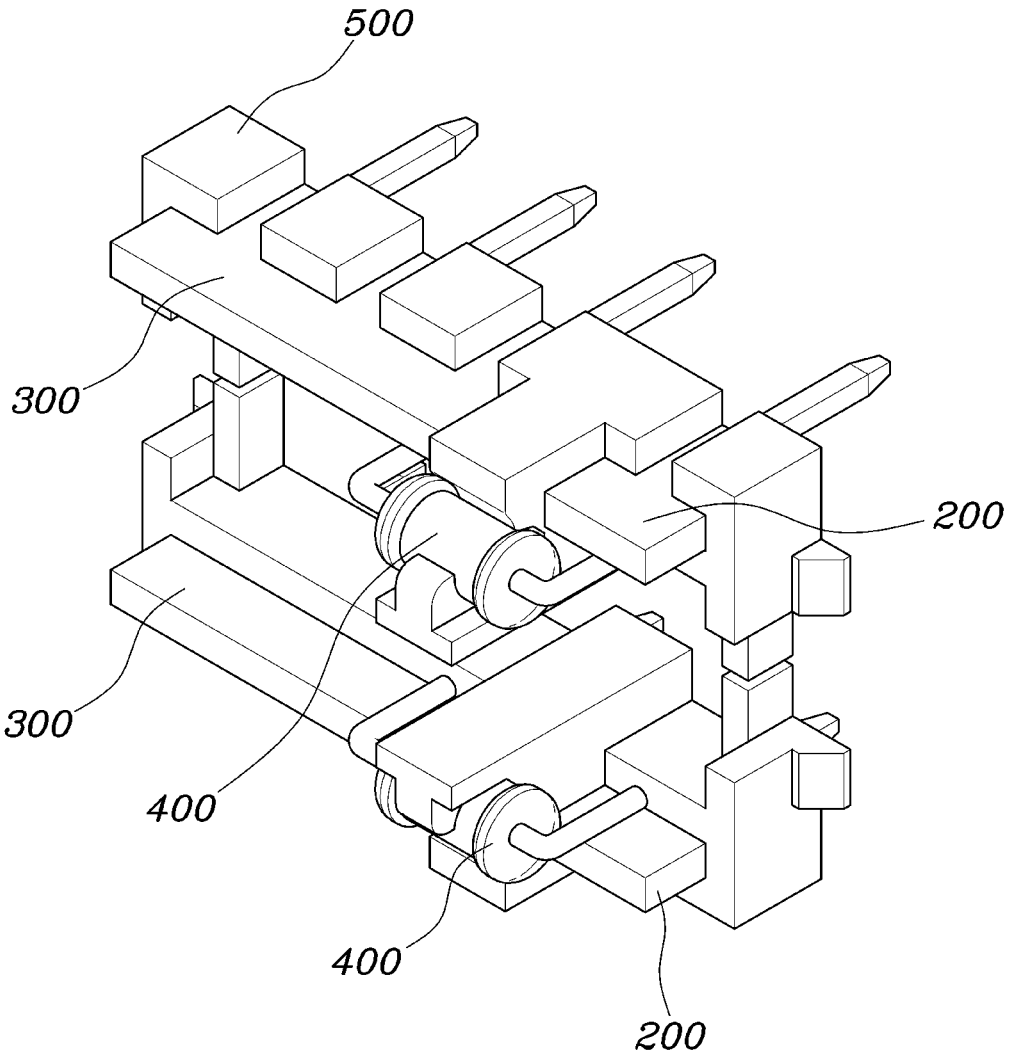
FIG. 5 shows that the main-line terminal and the sub-line terminal are coupled to the holder according to an embodiment of the present disclosure.

FIG. 4 shows that the main-line port 200, the sub-line port 300 and the holder 500 are coupled to one another according to an embodiment of the present disclosure, and FIG. 5 shows that the main-line port 200 and the sub-line port 300 are coupled to the holder 500 according to an embodiment of the present disclosure.

Referring further to FIGS. 4 and 5, the connector assembly may further include the holder 500 coupled to the housing 100 in the inner space 110 of the housing 100 to fix positions of the main-line port 200 and the sub-line port 300.

The holder 500 may be inserted into the inner space 110 of the housing 100 and integrally coupled with the housing 100. In addition, the holder 500 may be integrally coupled with the main-line port 200 and the sub-line port 300.

In an embodiment, the main-line port 200 and the sub-line port 300 may be fitted and coupled to the holder 500, and the main-line port 200 and the sub-line port 300 may be detachably coupled to the holder 500.

The noise filter 400 may be additionally coupled to the holder 500. The noise filter 400 may be disposed between the main-line port 200 and the sub-line port 300, and its opposite sides may each be in contact with and electrically connected to the main-line port 200 and the sub-line port 300.

A plurality of main-line ports 200 and a plurality of sub-line ports 300 may be provided and disposed to be spaced apart from each other on the holder 500 in a vertical direction.

In an embodiment, the holder 500 may have a plurality of stages spaced apart from each other in the vertical direction, and the plurality of main-line ports 200 and the plurality of sub-line ports 300 may be respectively disposed on the plurality of stages. The holder 500 may have two stages as shown in FIG. 5, and the main-line port 200 and the sub-line port 300 may be disposed at each stage.

The sub-line port 300 may include the plurality of pins disposed to be spaced apart from each other in a lateral direction to be electrically connected to the plurality of sub-line terminals S, respectively, and a busbar integrally connected to the plurality of pins, and the main-line port 200 and the sub-line port 300 may be disposed to be spaced apart from each other in the lateral direction.

The main-line port 200 and the sub-line port 300 coupled to the holder 500 including the plurality of stages may be disposed to be spaced apart from each other in the lateral direction.

In particular, the sub-line port 300 may have the plurality of pins each formed in the shape of a needle extending from the one integrated bus bar. The plurality of pins may be disposed to be spaced apart from each other in the lateral direction, and electrically connected to the sub-line terminals S, respectively. On the contrary, the main-line port 200 may have a single pin.

The plurality of noise filters 400 may be provided and disposed to be spaced apart from each other on the holder 500 in the vertical direction, and the plurality of noise filters 400 may be respectively disposed between the plurality of main-line ports 200 and the plurality of sub-line ports 300.

The plurality of noise filters 400 may be electrical resistors, and the respective noise filters may be coupled to the holder 500 while being spaced apart from each other in the vertical direction. In addition, the plurality of noise filters 400 may mediate between the plurality of main-line ports 200 and the plurality of sub-line ports 300.

One end of the noise filter 400 may be in contact with and electrically connected to the main-line port 200, and the other end of the noise filter 400 may be electrically connected to the sub-line port 300. In particular, the other end of the noise filter 400 may be connected to the bus bar of the sub-line port 300.

The connector assembly may further include a cover 600 fastened to the housing 100 to cover the main-line port 200 and the sub-line port 300 from the other side of the inner space 110.

The cover 600 may be fastened to the housing 100 to cover the other side of the inner space 110. The main-line port 200 and the sub-line port 300 may be inserted into the housing 100 through the other side of the inner space 110, and the cover 600 may cover the inserted main-line port 200 and the inserted sub-line port 300.

In an embodiment, clips may be formed on opposite side surfaces of the cover 600, and the cover 600 may be fastened to the housing 100 by being caught by and coupled to each protrusion formed on a side surface of the housing 100.

The cover 600 may be fastened to the housing 100, and it is thus possible to securely seal the main-line port 200 and the sub-line port 300 from the outside.

In addition, the cover 600 may be slid on the housing 100 while covering an outer surface of the housing 100, and may further include a waterproof sealant 610 between the outer surface of the housing 100 and an inner surface of the cover 600 to improve its waterproof performance.

In addition, the connector assembly may further include a retainer 700 fastened to the housing 100 to cover the main-line port 200 and the sub-line port 300 from the one side of the inner space 110, having through holes penetrated to allow the ends of the main-line terminal M and the sub-line terminal S to be inserted thereinto, and supporting the main-line terminal M and the sub-line terminal S which are inserted into the inner space 110.

The retainer 700 may fix and support the main-line terminal M and the sub-line terminal S, the ends of which are inserted into the inner space 110. In particular, the retainer 700 may have the plurality of through holes, into which the ends of the main-line terminal M and the sub-line terminal S are inserted, formed on a plane.

In addition, the retainer 700 may have a shape of the through hole or a separate mark to insert the main-line terminal M and the sub-line terminal S into an appropriate position in an appropriate direction.

In addition, the connector assembly may further include a sealing member 800 inserted into the one side of the inner space 110, covered by the retainer 700, and having covering holes surrounding outer peripheral surfaces of the main-line port 200 and the sub-line port 300 which are inserted into the inner space 110 through the through holes.

The sealing member 800 may be made of a material which may be elastically deformed such as silicone or rubber. The sealing member 800 may be inserted into the one side of the inner space 110 and covered from the outside by the retainer 700.

The sealing member 800 may have the plurality of covering holes formed to correspond to the plurality of through holes. The main-line terminal M and the sub-line terminal S may be inserted into the inner space 110 through the covering holes of the sealing member 800, and their outer peripheral surfaces may be surrounded by the holes of the cover 600.

In addition, the connector assembly may further include a fixing member 900 inserted into the one side of the inner space 110, covered by the retainer 700, and caught by and coupled to the ends of the main-line terminal M and the sub-line terminal S, which are inserted into the inner space 110 through the through holes to prevent separations of the main-line terminal M and the sub-line terminal S.

The fixing member 900 is a type of a terminal position assurance (TPA) mechanism, which may prevent the separations of the main-line terminal M and the sub-line terminal S which are inserted into the inner space 110 of the housing 100.

The main-line terminal M and the sub-line terminal S may each have the one end inserted into the housing 100, and may each be caught by and coupled to the fixing member 900 to prevent from being slid in a direction in which its end is separated from a specific relative position.

In particular, the fixing member 900 may allow the main-line terminal M and the sub-line terminal S to be slid in the direction in which the main-line terminal M and the sub-line terminal S are inserted into the inner space 110, and may prevent the main-line terminal M and the sub-line terminal S from being slid in the direction in which the main-line terminal M and the sub-line terminal S are separated from the specific relative position.

Figure 6:
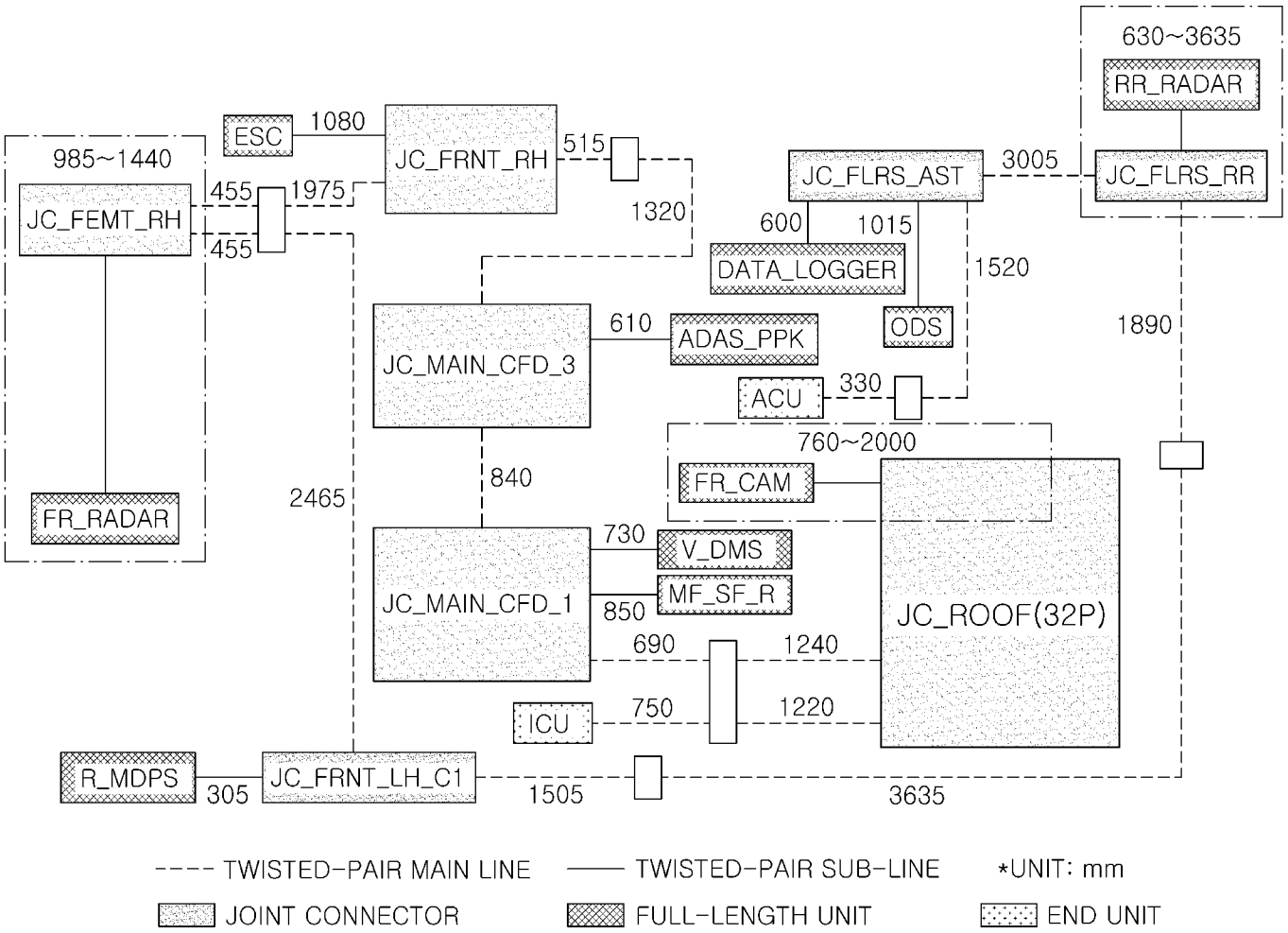
FIG. 6 shows that the connector assembly according to an embodiment of the present disclosure is used for a controller area network with flexible data-rate (CAN-FD).

FIG. 6 shows that the connector assembly according to an embodiment of the present disclosure is used for a controller area network with flexible data-rate (CAN-FD).

Referring further to FIG. 6, the noise filter 400 may be embedded in the connector assembly according to an embodiment of the present disclosure. When the connector assembly according to an embodiment of the present disclosure is used, it is possible to improve the degree of freedom in designing the length of the sub-line, which used to be pointed out as a limitation of the CAN-FD network, and it is thus possible to design the CAN-FD network to be suitable for a target application.

In particular, as shown in the drawing, the connector assembly according to an embodiment of the present disclosure may be used for a front radar (FR_RADAR), a front camera (FR_CAM) and a rear radar (RR_RADAR), and it is thus possible to significantly change the limit on the length of the sub-line connected thereto.

In addition, the connector assembly according to embodiments of the present disclosure may improve the performance of the CAN-FD network operated at a speed higher than the CAN network.

As set forth above, the connector assembly of embodiments of the present disclosure may remove the noise even though the length of the main line or the sub-line is changed by embedding the filter removing the noise from the signal in the connector assembly, thereby having improved freedom in designing the main line or the sub-line.

In addition, this configuration may be used even though there is no ground path for the noise, and may thus be used for the CAN/CAN-FD to remove the noise.

Although the present disclosure has been shown and described with respect to specific embodiments, it is apparent to those having ordinary skill in the art that the present disclosure may be variously modified and altered without departing from the spirit and scope of the present disclosure as defined by the following claims.

What is claimed is:

1. A connector assembly comprising:

a housing comprising an inner space formed therein, wherein ends of a first terminal and a second terminal are inserted into a first side of the inner space;

a first port inserted into and fixed to the inner space of the housing and electrically connected to the end of the first terminal inserted into the inner space;

a second port inserted into and fixed to the inner space of the housing and electrically connected to the end of the second terminal inserted into the inner space; and a noise filter disposed between the first port and the second port and electrically connected to each of the first port and the second port, wherein the noise filter is configured to reduce a noise in a signal transmitted between the first port and the second port.

2. The connector assembly of claim 1, wherein the noise filter is a low-pass filter for the signal transmitted between the first port and the second port.

3. The connector assembly of claim 2, wherein the noise filter is a resistor electrically connecting between the first port and the second port.

4. The connector assembly of claim 1, further comprising a holder coupled to the housing in the inner space of the housing and configured to fix positions of the first terminal and the second terminal.

5. The connector assembly of claim 1, further comprising a cover fastened to the housing to cover the first port and the second port from a second side of the inner space.

6. The connector assembly of claim 1, further comprising a retainer fastened to the housing to cover the first port and the second port from the first side of the inner space, wherein the retainer has through holes to allow the ends of the first terminal and the second terminal to be inserted thereinto, and wherein the retainer is configured to support the ends of the first terminal and the second terminal inserted into the inner space.

7. The connector assembly of claim 6, further comprising a sealing member inserted into the first side of the inner space, covered by the retainer, and having covering holes, the covering holes surrounding outer peripheral surfaces of the ends of the first terminal and the second terminal which are inserted into the inner space through the through holes.

8. The connector assembly of claim 6, further comprising a fixing member inserted into the first side of the inner space, covered by the retainer, and caught by and coupled to the ends of the first terminal and the second terminal which are inserted into the inner space through the through holes of the retainer to prevent separations of the first terminal and the second terminal.

9. A connector assembly comprising:

a housing comprising an inner space formed therein, wherein ends of a plurality of first terminals and a plurality of second terminals are inserted into a first side of the inner space;

a plurality of first ports inserted into and fixed to the inner space of the housing and electrically connected to respective ones of the ends of the plurality of first terminals inserted into the inner space;

a plurality of second ports inserted into and fixed to the inner space of the housing and electrically connected to respective ones of the ends of the plurality of second terminals inserted into the inner space;

a plurality of noise filters disposed between and connected to respective ones of the plurality of first ports and the plurality of second ports, wherein each of the plurality of noise filters is configured to reduce a noise in a signal transmitted between the respective ones of the plurality of first ports and the plurality of second ports; and a holder coupled to the housing in the inner space of the housing to fix positions of the plurality of first terminals and the plurality of second terminals, wherein the plurality of first terminals and the plurality of second terminals are spaced apart from each other on the holder in a vertical direction.

10. The connector assembly of claim 9, wherein each of the plurality of second ports includes:

a plurality of pins spaced apart from each other in a lateral direction and configured to be electrically connected to the plurality of second terminals, respectively; and a busbar integrally connected to the plurality of pins.

11. The connector assembly of claim 10, wherein the plurality of first ports and the plurality of second ports are spaced apart from each other in the lateral direction.

12. The connector assembly of claim 11, wherein the plurality of noise filters are spaced apart from each other on the holder in the vertical direction.

13. The connector assembly of claim 12, wherein the plurality of noise filters are respectively disposed between the plurality of first ports and the plurality of second ports.

14. A method of providing a connector assembly, the method comprising:

inserting ends of a first terminal and a second terminal into a first side of an inner space formed in a housing;

fixing a first port in the inner space of the housing and electrically connecting the first port to the end of the first terminal inserted into the inner space;

fixing a second port in the inner space of the housing and electrically connecting the second port to the end of the second terminal inserted into the inner space; and disposing a noise filter between the first port and the second port and electrically connecting the noise filter to each of the first port and the second port, wherein the noise filter reduces a noise in a signal transmitted between the first port and the second port.

15. The method of claim 14, wherein the noise filter is a low-pass filter for the signal transmitted between the first port and the second port.

16. The method of claim 15, wherein the noise filter is a resistor electrically connecting between the first port and the second port.

17. The method of claim 14, further comprising coupling a holder to the housing in the inner space of the housing, wherein the holder fixes positions of the first terminal and the second terminal.

18. The method of claim 14, further comprising fastening a cover to the housing to cover the first port and the second port from a second side of the inner space.

19. The method of claim 14, further comprising fastening a retainer to the housing to cover the first port and the second port from the first side of the inner space, wherein the retainer has through holes allowing the ends of the first terminal and the second terminal to be inserted thereinto, and wherein the retainer supports the ends of the first terminal and the second terminal inserted into the inner space.

20. The method of claim 19, further comprising:

inserting a sealing member into the first side of the inner space, the sealing member being covered by the retainer and having covering holes, wherein the covering holes surround outer peripheral surfaces of the ends of the first terminal and the second terminal which are inserted into the inner space through the through holes; and inserting a fixing member into the first side of the inner space, the fixing member being covered by the retainer and caught by and coupled to the ends of the first terminal and the second terminal which are inserted into the inner space through the through holes of the retainer to prevent separations of the first terminal and the second terminal.

* * * * *